US007977566B2

(12) United States Patent
Haddad

(10) Patent No.: US 7,977,566 B2
(45) Date of Patent: Jul. 12, 2011

(54) OPTICAL INSTRUMENT PICKUP

(75) Inventor: Waleed Sami Haddad, San Francisco, CA (US)

(73) Assignee: Waleed Sami Haddad, San Francisco, CA (US)

( * ) Notice: Subject to any disclaimer, the term of this patent is extended or adjusted under 35 U.S.C. 154(b) by 0 days.

(21) Appl. No.: 12/561,409

(22) Filed: Sep. 17, 2009

(65) Prior Publication Data

US 2011/0061517 A1 Mar. 17, 2011

(51) Int. Cl.
*G10H 3/06* (2006.01)

(52) U.S. Cl. ..... 84/724

(58) Field of Classification Search ..... 84/724
See application file for complete search history.

(56) References Cited

U.S. PATENT DOCUMENTS

| | | | | |
|---|---|---|---|---|
| 4,429,607 | A | 2/1984 | Meno | |
| 4,815,353 | A | 3/1989 | Christian | |
| 5,012,086 | A | 4/1991 | Barnard | |
| 5,214,232 | A | 5/1993 | Iijima et al. | |
| 5,237,126 | A | 8/1993 | Curtis | |
| 7,060,887 | B2 * | 6/2006 | Pangrle | 84/724 |
| 2006/0162534 | A1 * | 7/2006 | Muramatsu | 84/724 |
| 2006/0174756 | A1 * | 8/2006 | Pangrle | 84/724 |
| 2008/0282873 | A1 * | 11/2008 | Kotton et al. | 84/645 |
| 2010/0011942 | A1 * | 1/2010 | Wessels | 84/724 |

FOREIGN PATENT DOCUMENTS

EP 0545918 2/1996

OTHER PUBLICATIONS

Apr. 25, 2011, International Search Report and Written Opinion dated Apr. 25, 2011 from PCT Application No. PCT/US2010/049254, 8 pages.

* cited by examiner

*Primary Examiner* — Jeffrey Donels
(74) *Attorney, Agent, or Firm* — Hollingsworth & Funk, LLC

(57) ABSTRACT

A optoelectronic pickup for a musical instrument includes at least one light source which directs light to impinge a string of the musical instrument in at least one photoreceiver located to detect the reflected light, so as to generate an electrical signal that is responsive to string vibrations. A number of dissimilar filter approaches are included to control undesired effects of spurious light, the filter approaches may be structure-based, signal processing-based, and/or optics-based.

24 Claims, 7 Drawing Sheets

OPTICAL INSTRUMENT PICKUP

TECHNICAL FIELD

This application relates generally to a pickup for string instruments. More particularly, the present invention relates to a pickup apparatus for string instruments that employs optical components to discern the location of instrument strings during play, thereby providing enhanced sound generation and enabling other features.

BACKGROUND

A traditional electric guitar pickup utilizes magnets and a wire coil to produce sound. It also requires the guitar strings to be made of a ferro-metal. When the ferro-metal strings of the guitar are strummed within the magnetic field produced by the fixed magnets of the pickup, a time-varying voltage is induced in the coil. This time-varying voltage can then be amplified to produce sound. The voltage represents the speed of an instrument string as it vibrates. While this configuration is sufficient to produce sound, it includes limitations with respect to accurately representing the string vibrations, and does not provide the musician with much control of the sound. Furthermore, magnetic pickups can be susceptible to interference from other magnetic or electronic sources, which can diminish sound quality.

In addition to magnetic guitar pickups, optical pickups have been developed. Optical pickups utilize a light field to detect the actual position of the string, thereby enabling more precise play. However, known optical pickups are only offered on custom guitars and must be installed by a manufacturer. Generally speaking, current optical pickups use a trans-illumination configuration. They employ a light source on one side of an instrument string and a sensor diametrically opposite to the light source, creating a shadow of the string on the sensor. The position of the shadow, or of its edge, can be monitored by the sensor and converted into a voltage signal which varies with the motion of the string. This configuration is susceptible to problems with ambient light and typically requires components to be mounted between the strings. It may also have a limited sensing range, allowing it only to be used where the string displacement is very small, and may require "recalibration" when strings are changed. These optical pickups are built into the bridge of the instrument (where the strings are fixed at the tail of the instrument body) and are covered to prevent entry of interfering light. Therefore, if a musician wishes to employ such an optical pickup, he must purchase a new instrument. Not only does this place an economic burden on the musician, but he must replace his current instrument which, apart from the pickup, may be more desirable than the one equipped with the optical pickup.

What is desired is an optical pickup apparatus that can enable precise play and enable sound enhancement and adjustment. Furthermore, what is desired is an optical pickup apparatus that can be installed on an existing instrument.

SUMMARY

An optoelectronic pickup of a musical instrument in accordance with the invention includes at least one light source positioned to direct light to impinge an instrument string of the musical instrument and at least one photoreceiver located to detect reflected light from the string so as to generate an electrical signal that is responsive to the detection of reflected light. A number of dissimilar filter approaches (means) are included to control affects of spurious light upon the electrical signal, where the spurious light is light energy that is directed toward a photoreceiver and that is unrelated to a condition of the instrument string. The dissimilar filter approaches of a particular embodiment may be taken from a single filter category or may be selected from different categories.

One filtering category includes those filter approaches that are implemented following the reflection of the light by the instrument string (i.e., the post-reflection approaches). A barrier may be placed between adjacent photoreceivers to block light reflected by one string from reaching a photoreceiver associated with a different string. An additional or alternative approach is to provide a stepped structure which limits the path to a photoreceiver. For example, the stepped structure may be a tube-shaped structure that is ribbed in a tiered fashion to defuse reflections of light from its walls, thereby reducing the capture of interfering light. A light filter may also be a barrier with a small slit, typically at its center to dictate the path of light to a photoreceiver The light filter can be positioned to channel only light that is in line with its slit, thereby ensuring only the light collected by an optical lens, which may have its first and second foci located at the string and the slit, respectively, is allowed to fall upon the associated photoreceiver, thereby limiting the acceptance of light from distances and angles outside of the desired detection range. The optical lens may be a cylindrical lens. In addition to or as an alternative to employing barriers, the photoreceivers can be spaced at particular, irregular positions to better ensure reception of the "correct" reflected light. The photoreceivers and/or the light sources can be located in pairs adjacent to or offset from the positions of the strings of the musical instrument.

Filtering approaches may also be implemented post-reception of the optical signal. Room lighting typically includes modulation as a result of fluctuations in the alternating electric current which powers the room lamps. Spurious light typically falls upon all of the photoreceivers with generally equal intensity. The signals generated by adjacent photoreceivers may be inverted relative to each other. Then, when the signals are summed, the modulated room lighting can be cancelled. As an example, on a six-string guitar, three output signals from the photoreceivers will be "normal" and the remaining three will be "inverted," so as to allow reduction of the effect of interference.

Other filtering approaches may be considered to be a cooperation between light emission and light reception. Each light source may be modulated at a specific frequency that is higher than the highest audible frequency produced by the vibration of the musical string. As a consequence, the modulation frequency may be considered as the carrier upon which the string vibration signal is superimposed. Signal processing that is downstream of the associated photoreceiver can be configured to demodulate the received light signal so as to remove the carrier so as to filter spurious signals from outside light sources. Another approach is to tailor the optical bandwidths of the light source and the photoreceiver. Thus, the bandwidth of the photoreceiver may be tailored to preferentially pass the frequency spectrum of the light source.

Optical filters may also be placed across one or more of the light sources, thereby affecting the beam pattern of the emitted light and, in turn, the resulting sound. The optical filter may be a translucent plastic which diffuses the emitted light. A lenticular array may be employed to diffuse the light in one direction, but not the other. Optical filters may be created with a varying amount of absorption along their lengths or widths, thus causing the emitted light to have a pattern of greater and lesser intensities as desired at various locations in space. This variation in the illumination pattern at the plane of the strings changes the voltage signal that is indicative of the string vibration, so as to affect the tone or timbre of the sound produced by the instrument. A lens or multiple lenses may be added at the light sources to concentrate or shape the light. Optical filters at the light sources may also be structure based openings that channel the emitted light in a particular fashion, such as by narrowing the light in one direction.

BRIEF DESCRIPTION OF THE DRAWINGS

In order to describe the manner in which the above recited and other advantages and features of the invention can be obtained, a more particular description of the invention briefly described above will be rendered by reference to specific embodiments thereof that are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION

Figure 1:
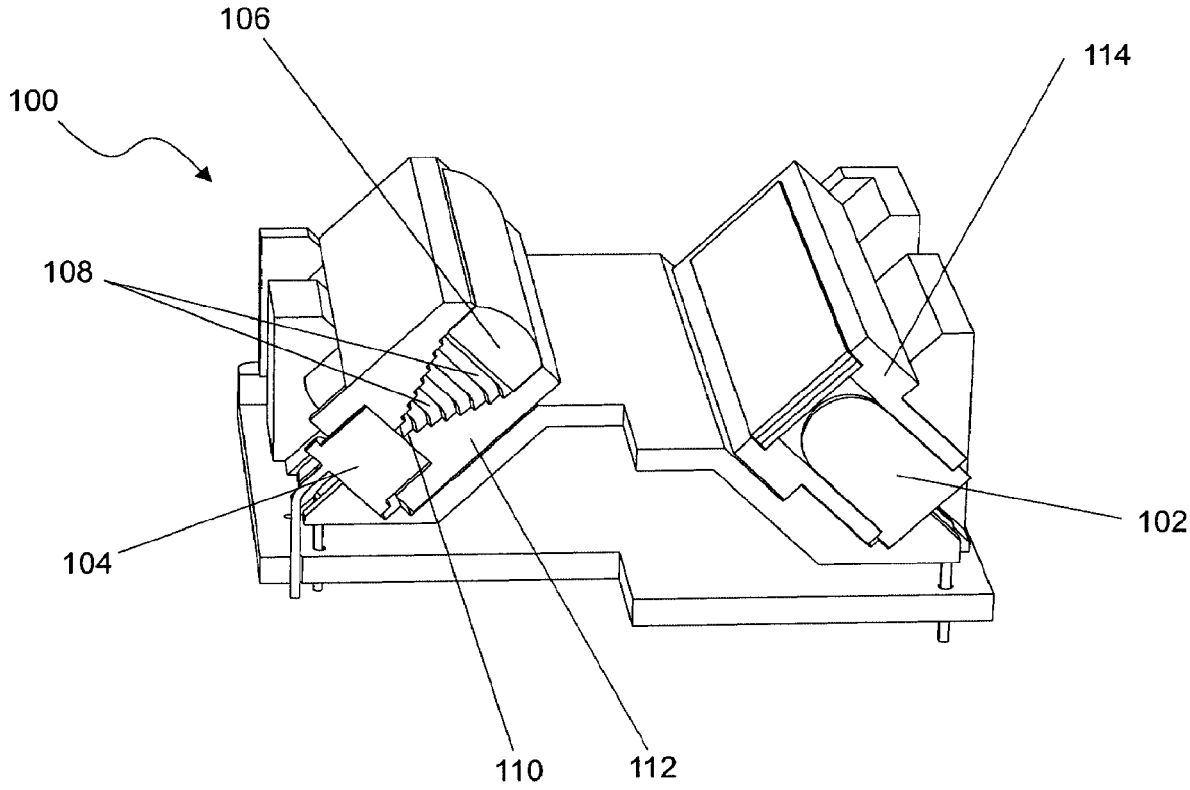
FIG. 1 illustrates an example of a perspective view of a cutaway section of the pickup in accordance with one embodiment of the present invention.

An optoelectronic pickup in accordance with the invention utilizes filtering to control the affects of spurious light. As used herein "spurious light" is defined as light energy that is directed toward a photoreceiver and is unrelated to a condition of an instrument string associated with the photoreceiver. There are a number of possible sources of spurious light. Stage lighting, room lighting and sunlight provide high intensity spurious light, but less intense surrounding light is also a concern. Another possible source is reception of light from an "unassociated" instrument string. While an exhaustive list of the sources is not intended, it should be noted that reflections will also occur from the fingers and/or the "pick" used in playing the instrument. The reflecting objects tend to have movements at a much lower frequency than the instrument string. The resulting spurious light information can be removed using signal processing or analog electronic filtering techniques, but filtering of spurious light from other sources may be more easily or effectively accomplished using optical-based filters or structure-based filters, alone, or in combination with electronic filtering or processing techniques.

As previously noted, a standard pickup creates a magnetic field and detects an instrument string as it vibrates in this field, thereby measuring the speed of the movement of the string. It then translates this signal into sound. While the configuration of a magnetic pickup is sufficient for sound production, it provides limited frequency content, and as such provides a limited sound. Furthermore, a magnetic pickup can be susceptible to magnetic damping, which can limit the duration of a particular sound (i.e., the "sustain" of the instrument). Conversely, the configuration of the pickup of the present invention (herein referred to as "pickup 100") enables the detection of the position of an instrument string as it vibrates, thereby allowing pickup 100 to capture more frequency content and, thus, generate a more robust sound. This position information can be used as a control signal, allowing the musician another channel for expressive playing. Additionally, because pickup 100 does not employ a magnetic field, it is not susceptible to the interfering elements that can cause a magnetic pickup to produce a hum or buzz. Because pickup 100 senses string motion optically and captures more frequency content, it enables other features than can be used to modify the sound produced. As described below, pickup 100 can enable electronic control of individual string volume, tone, and other characteristics, and can employ optical filters to modify the signal, change the harmonic content, and the like, in order to allow a musician to create a "signature sound." Although the description herein generally describes pickup 100 as installed in an electric guitar, this is not to be construed as limiting, as the present invention can be implemented on any stringed musical instrument.

Unlike current optical pickup apparatuses, pickup 100 does not need to be installed into a musical instrument at the time of its manufacture. The design of pickup 100 allows it to be added to an existing instrument. That is, pickup 100 may be installed as a retrofit assembly. For example, a guitarist can replace the magnetic pickup of his guitar with pickup 100. Typical magnetic pickups are mounted below the strings and in one or more locations in the open center of the guitar body, between the end of the neck and the bridge. Magnetic pickups come in several form factors, but there are prevailing standard form factors for these pickups which enable interchangeability of one brand of pickup with another. Perhaps the most common and popular type of pickup is the "humbucker," which has two coils and rows of magnets and is constructed with a standardized form factor. Pickup 100 is fundamentally different from known optical pickups in that it can be specifically designed so that it can be packaged in the standard humbucker form factor, and as such pickup 100 can be mounted, positioned, and electrically wired into the guitar exactly as a typical magnetic humbucker. The technology of pickup 100 uses reflection-mode illumination and a unique optical illumination and sensing scheme that can allow it to work with a larger range of string motion and to reject interference caused by ambient light. In general, musicians are particular about the instruments they play, and the modular nature of pickup 100 allows a musician to, for example, enhance the sound of his current instrument, rather than replace it. This can be particularly advantageous if a musician uses an instrument of exceptional quality or one having a particularly desirable characteristic. Furthermore, pickup 100 can be added to acoustic instruments to enable them to produce sound electronically.

Figure 2:
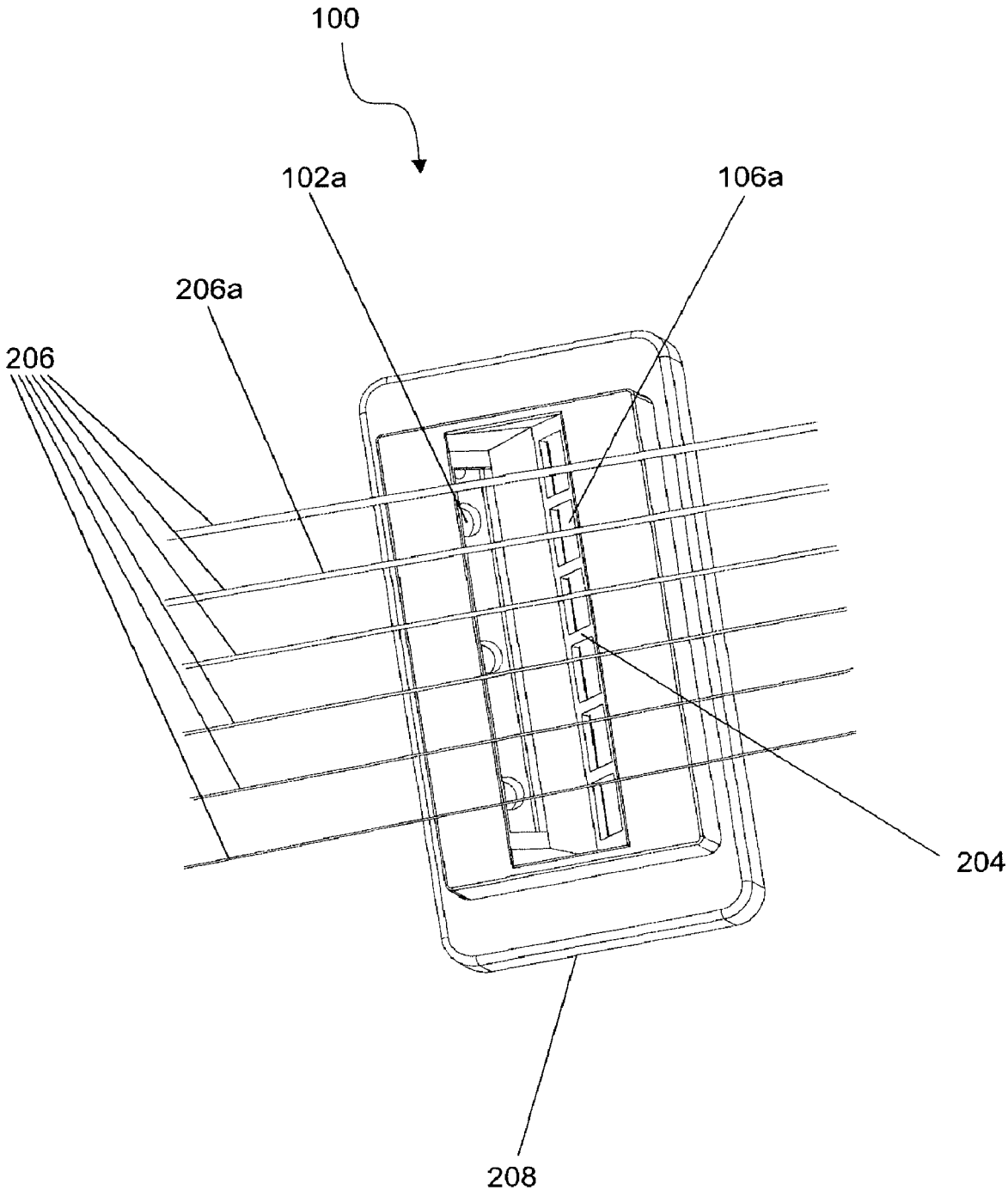
FIG. 2 illustrates an overhead view of the pickup of FIG. 1 as applied to an instrument having six strings.
Figure 4:
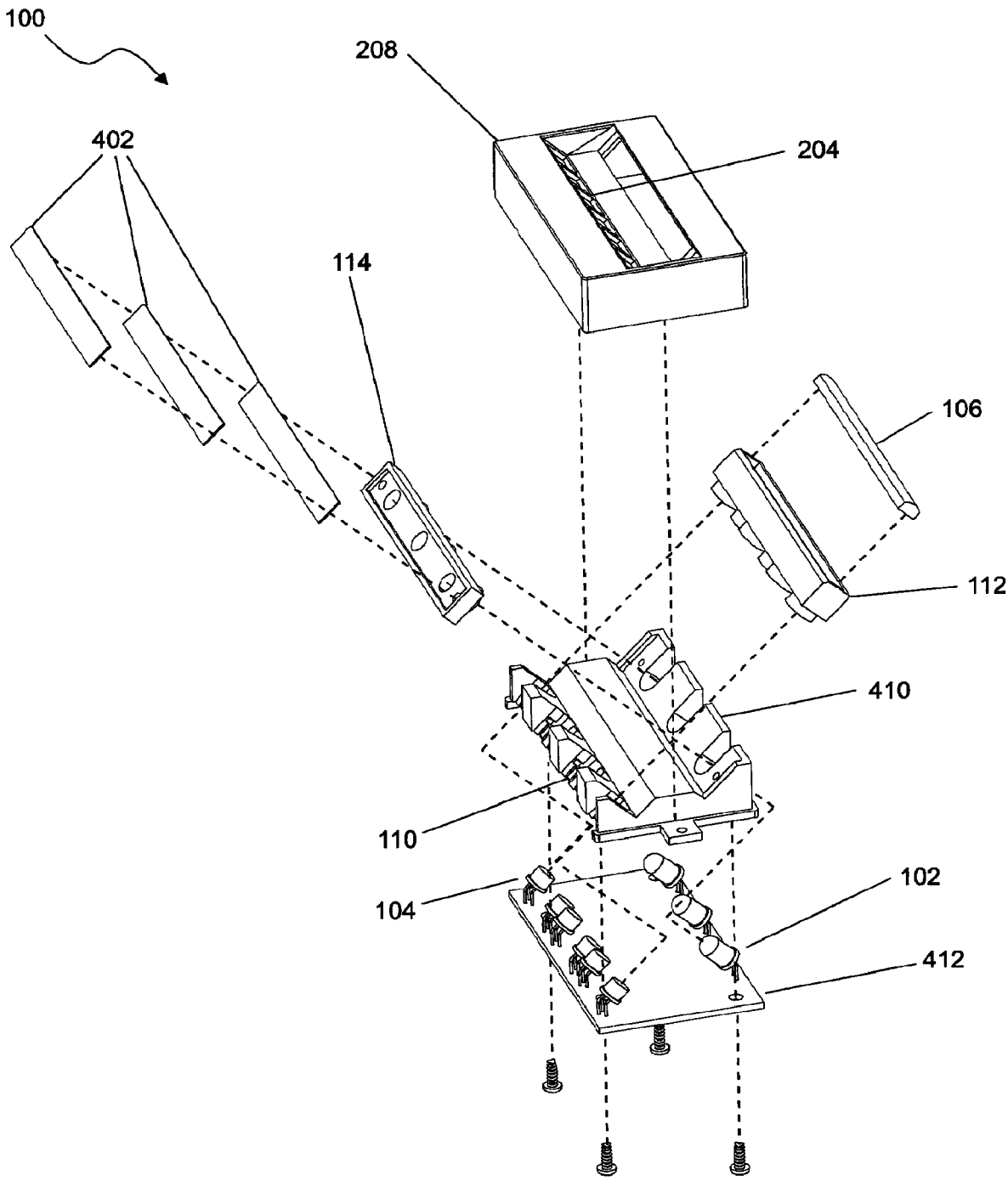
FIG. 4 illustrates an exploded view of the pickup of the embodiment of FIG. 1.

FIG. 1 illustrates one possible embodiment of pickup 100. Pickup 100 can include one or more light sources 102. For example, as depicted in FIG. 2, pickup 100 can include three light sources 102. Each of the light sources 102 can be positioned in proximity to a pair of instrument strings 206. That is, there may be a two-to-one relationship of strings and light sources. In one embodiment, light source 102 can be an infrared, light-emitting diode (LED). For example, light source 102 can be a Gallium-Aluminum-Arsenide (GaAlAs) LED, such as one manufactured by Vishay Semiconductors, which emits light of a narrow wavelength bandwidth (e.g., centered around 870 nanometers). The light emitted from light source 102 can be projected as a cone, with the light brightest at its center and becoming gradually dimmer towards the exterior of the cone. As shown in FIG. 1, light source 102 can be positioned at an angle via illuminator flange 114 to ensure the light is effectively reflected from the instrument string(s) 206. For example, as shown in FIG. 4, light source 102 can be positioned via base 410 so that the light is emitted at a 45 degree angle and strikes instrument string 206 five to eight millimeters from light source 102. Light source 102 can be positioned to project the middle of the cone of light between a pair of adjacent instrument strings 206, and as such the emitted light can be reflected off one or more instruments strings 206. For example, referring to FIG. 2, moving string 206*a* up will position it closer to the center of the cone of light emitted from light source 102*a*, and therefore into a region of brighter illumination resulting in more reflected light into lens 106*a*, and thus, into photosensor 104, in turn resulting in an increase in its voltage output. Moving string 206*a* down will cause it move away from the brightest region of light emitted from light source 102*a*, causing the voltage signal from photosensor 104 to decrease. Instrument string 206 can be a typical instrument string, as a typical instrument string can be composed of material that can enable a sufficient reflection. Alternatively, instrument string 206 can be composed of a specific material that can enable or enhance the functionality of pickup 100.

The reflected light can travel downwards, at an opposite angle relative to the light incident to the instrument string, towards one or more photosensors 104. Pickup 100 can include multiple photosensors 104 to enable the capture of light emitted from the light sources 102 and reflected off the instrument strings 206. As depicted by FIG. 2, pickup 100 can include one or more photosensors 104. Photosensor 104 can be positioned at an angle via base 410 to ensure that the light is captured accurately. The spacing of photosensor 104 can vary per implementation. In one embodiment, sensors 104 are evenly spaced in a row opposite a row of light sources 102 via receiver flange 112. A photosensor 104 can be associated with a particular instrument string 206, thereby enabling pickup 100 to create a sound for the particular instrument string 206 (i.e., there is a one-to-one relationship of photosensors and instrument strings.) However, if photosensor 104 is misaligned, such as due to improper placement of pickup 100 on the instrument, photosensor 104 can receive the reflected light from the incorrect instrument string 206 (e.g., the adjacent string). A barrier 204 can be placed between one or more photosensors 104 to prevent photosensor 104 from receiving the reflected light from the wrong instrument string 206 by shielding photosensor 104 from the light reflected from other instrument strings 206. Thus, the barrier reduces or eliminates optical crosstalk. Barrier 204 can be included with pickup 100 during installation or can be added subsequently. For example, as shown in FIG. 2, barrier 204 can be integrated into a pickup cover 208.

In addition to, or instead of, employing barriers 204, photosensors 104 can be spaced at particular, irregular positions to ensure reception of the correct reflected light. Photosensors 104 can be located in pairs adjacent to the positions of the instrument strings 206. As aforementioned, the light emitted from a light source 102 can be reflected off instrument string 206 at a downward angle. As the light is emitted as a cone, the light reflected downward can also be cone-shaped. Placing photosensor 104 adjacent to the position of instrument string 206, rather than immediately beneath it, can ensure that the reflected cone-shaped light is captured by the appropriate photosensor 104 and not by a neighboring photosensor 104.

Figure 5:
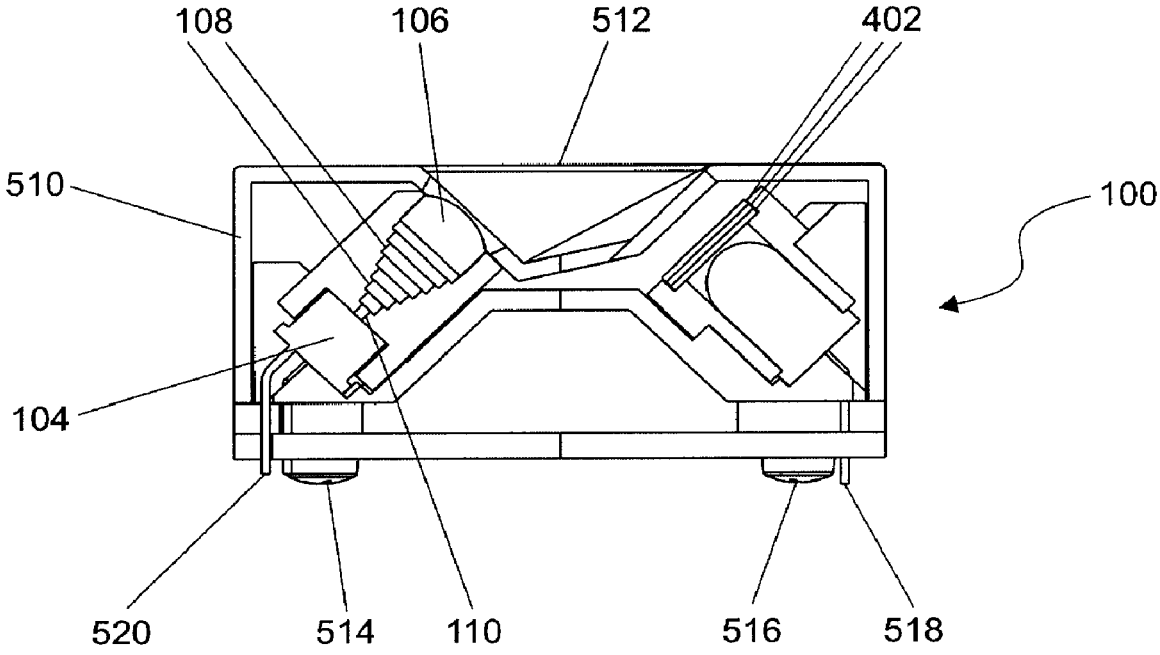
FIG. 5 illustrates a cutaway side view showing internal components of one embodiment of the invention. The split-plane cutaway in this figure corresponds to that of FIG. 1.

Pickup 100 can capture the light emitted from light source 102 via lens 106, stepped structure 108, light filter 110, and photosensor 104. As depicted in FIG. 1, lens 106 can be a single component (e.g., a single pane) incorporated across multiple photosensors 104. However, this is not to be construed as liming, as pickup 100 can include an individual lens 106 for each photosensor 104. If one or more barriers 204 are desired, barrier 204 can be affixed above or below the single lens component. Lens 106 can be a cylindrical lens and can capture the light reflected off instrument string 206 and can channel the light into stepped structure 108. A cylindrical lens ensures that the received light is focused only in one direction (i.e., towards photosensor 104). Stepped structure 108 can be a tube-shaped structure that is ribbed in a tiered fashion. One embodiment of a stepped structure is shown in FIG. 5. This design can allow stepped structure 108 to defuse reflections of light from the walls of its tube-shaped structure that did not originate from light source 102, thereby reducing the capture of interfering light. Therefore, stepped structure 108 can discriminately pass the emitted light to light filter 110. Light filter 110 can be a barrier with a small slit, typically at its center. Light filter 110 can be positioned to channel only light that is in line with its slit, thereby ensuring only the emitted light collected by lens 106 is allowed to fall on photosensor 104. For example, the emitted light can reflect off instrument string 206 on a horizontal plane and light filter 110 can block any light not on this plane. Stepped structure 108 and/or light filter 110 can be integrated with receiver flange 112. For example, receiver flange 112 can be a molded component designed to include a stepped structure 108 and light filter 110 for each photosensor 104. In other embodiments stepped structure 108 and/or light filter 110 can be separate components or integrated with one or more other components.

Once the emitted light has passed through light filter 110, photosensor 104 can receive it. Photosensor 104 can be composed of one or more various materials. In one embodiment, photosensor 104 can be a diode composed of silicon, such as an NPN silicon phototransistor manufactured by Optek. Silicon diodes can sense light from a range of wavelengths. Alternatively, photosensor 104 can be a diode composed of GaAlAs, such as a GaAlAs diode manufactured by Opto Diode Corporation. A GaAlAs diode can be sensitive to a narrow range of wavelengths, enabling it to receive only the same narrow bandwidth of light emitted from a GaAlAs LED light source 102, and thereby significantly reducing interference from background light without reducing sensitivity to the light reflected from the strings. That is, the signal-to-noise ratio is improved.

In order to further prevent interference from outside light sources, light source 102 can be modulated at a specific frequency higher than the highest audible frequency produced by the string vibration (e.g., 100 to 200 kilohertz). This can act as a carrier frequency onto which the string vibration signal will be superimposed. The electronics of pickup 100 behind photosensor 104 can be configured to demodulate the received light signal, removing the carrier, and preserving the vibration signal from the string. This enables pickup 100 to filter out all spurious signals from outside light sources (e.g., anything not at the carrier frequency of 100 to 500kilohertz). The supporting electronics of pickup 100 can be affixed to circuit board 412. Additionally, the various components of pickup 100 can be mounted on circuit board 412.

Once the light is received by photosensor 104, the light can be analyzed to determine the position of instrument string 206 at the time of reflection, and this data can be employed to generate sound. The closer instrument string 206 is moved towards the center of the cone of light, the more light it reflects. As such, the signal becomes stronger and the associated voltage increases. Conversely, when instrument string 206 is moved away from light source 102, it moves farther from the center of the cone of light and the signal, and the associated voltage, decreases. As the strength of the signal varies per the position of instrument string 206 in the cone of light, the strength of the signal allows pickup 100 to determine the position of instrument string 206 as it vibrates. Because pickup 100 can generate sound based on the position of the instrument string 206, rather than solely on its vibration, pickup 100 can capture low frequency information that cannot be captured via a traditional pickup. For example, pickup 100 can capture a signal at zero frequency.

In addition to capturing the string vibrations by sensing the position of instrument string 206 as it moves in time, pickup 100 can produce a signal similar to a standard magnetic pickup by tailored filtering or by taking the derivative of the position signal (which is related to the speed of the vibrating instrument string 206) via analog or digital electronics. Instrument string 206 vibrates in three dimensions and the configuration of pickup 100 enables it to obtain a signal indicative of the position of instrument string 206 as it vibrates in three dimensions. Pickup 100 also does not have inherent filtering of harmonic content due to inductance as does a magnetic pickup. This allows pickup 100 to obtain a broad range of information about instrument string 206, thereby enabling pickup 100 to generate a more robust sound and provide harmonics not possible with a traditional pickup.

Optical pickups can be susceptible to interference caused by the modulation of external light sources. For example, the light emitted from room lamps can modulate due to fluctuations in the alternating electric current powering the lamps. Generally, light from room lamps may fall upon all sensors 104 fairly evenly, but the signals from the strings are independent, and their phase is not critical. The signals of one or more photosensors 104 can be inverted to reduce such interference. For example, on a six-string guitar, pickup 100 can be configured so that normal and inverted sensors signals alternate from one photosensors 104 to the next (i.e., three photosensors signals are normal and three are inverted). When the normal and inverted signals are summed together, the modulated signal from the room lamps from the three inverted photosensors' signals can cancel out the signals from the three normal channels, thus reducing the effect of the interference. This is effectively an "optical humbucker." Even though the phase information of the vibration of the strings is not in general critical, in the preferred embodiment which uses a single light source 102 to illuminate two adjacent strings, the signals received from identical motion of the pair of adjacent strings would be exactly 180 degrees out of phase with each other due to the illumination scheme, when in fact they should be exactly in phase. Therefore, the inversion of adjacent pairs of photosensors to form the optical humbucker, actually corrects for this phase difference.

As illustrated in FIG. 4, in one embodiment, pickup 100 can be designed to enable the use of one or more optical filters 402. Optical filter 402 can be placed across one or more light sources 102, thereby affecting how the light is emitted and, in turn, affecting the resulting sound. For example, one or more optical filters 402 can be affixed to illuminator flange 114. In addition to assisting with the positioning of light sources 102, illuminator flange 114 can enable the mounting of optical filters 402 and the like. Optical filter 402 can be transparent (or semi-transparent) and can be constructed of metal, glass or plastic. For example, optical filter 402 can be a translucent pane of plastic that can be fitted over the light sources 102 shown in FIG. 2 to diffuse the emitted light. Optical filter 402 can be created with a varying amount of absorption along its length or width, thus causing the pattern of light emitted by one or more light sources 102 to be brighter or darker as desired at various locations in space. This can be used to create different illumination patterns at the plane of the strings, thereby changing the shape of the voltage signal produced as the string vibrates, and thus affecting the tone or timbre of the sound produced by the instrument. In another scenario, optical filter 402 need not be transparent and can include one or more openings that channel the emitted light in a particular fashion, such as by narrowing the light in one direction. For example, optical filter 402 can be designed to include one or more grooves that run its length. Alternatively, filter 402 can include a lenticular array that diffuses the emitted light in only one direction. In one embodiment, pickup 100 can enable the use of multiple optical filters 402 at once (as shown in FIGS. 4 and 5). For example, pickup 100 can allow optical filters 402 to be stacked upon another, with each optical filter 402 affecting the emitted light as it is channeled from one optical filter 402 to another, thereby allowing the player of the instrument to even further manipulate its sound. In another scenario, distinct optical filters 402 can be placed over one or more individual light sources 102. In an alternative embodiment, instead of, or in addition to, enabling the use of interchangeable optical filters 402, pickup 100 can include one or more integrated optical filters 402. In addition, one or more of the components 402 can be a lens, or array of lenses to either concentrate or spread the illuminating light in order to improve signal to noise, or produce other desirable sound characteristics.

Figure 3:
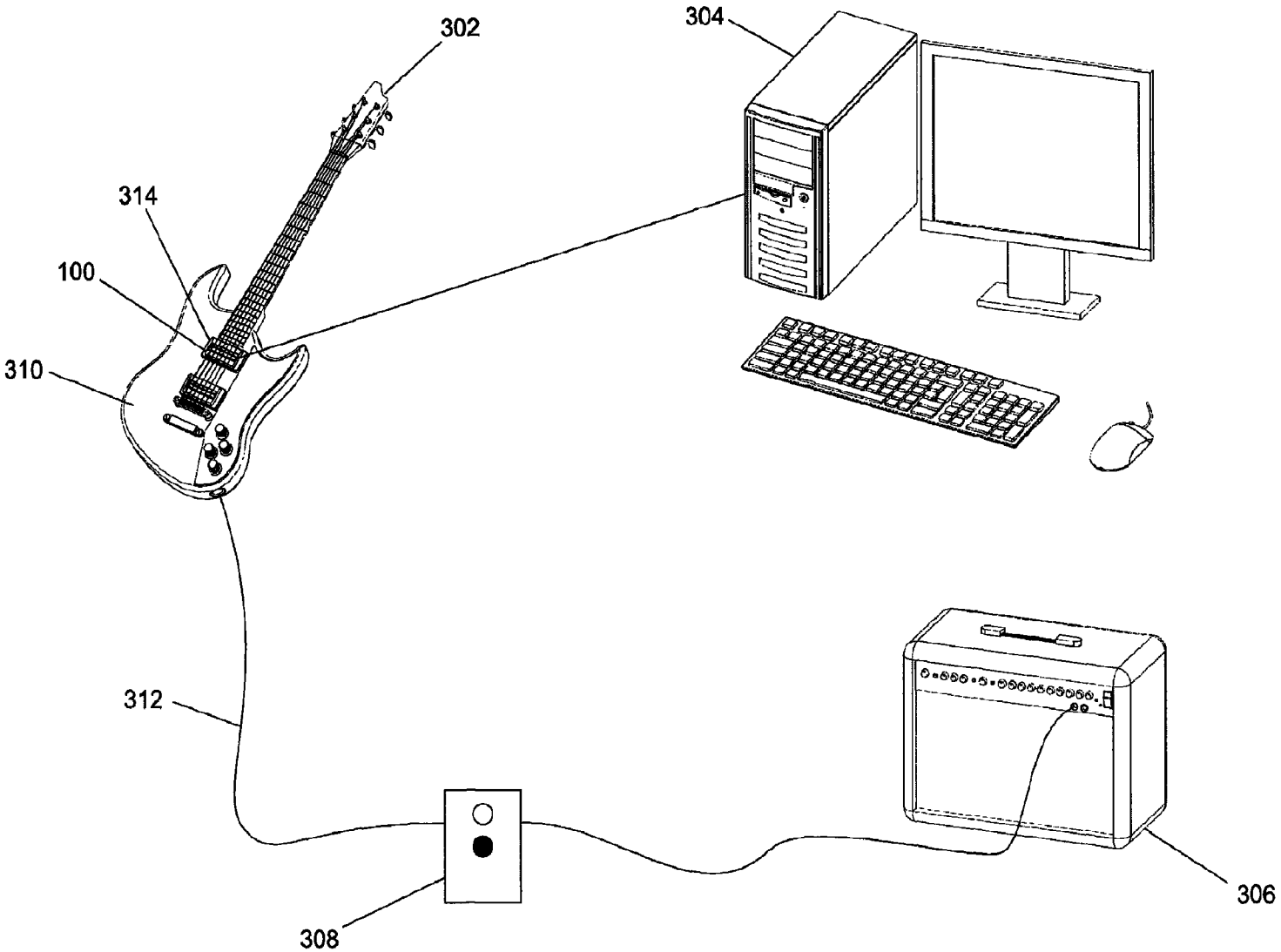
FIG. 3 illustrates a general architecture overview of a system for powering and/or interfacing with the pickup of the present invention.

In addition to the aforementioned features, pickup 100 can include microprocessor 314 that can enable pickup 100 to be controlled and programmed. As depicted in FIG. 3, pickup 100 can also include an interface to allow pickup 100 to communicate with an external computer system 304, such as a personal computer, a mobile device (e.g., a personal digital assistant, an iPhone, a mobile phone, etc.), or specially designed remote control unit. For example, the remote control unit can be designed to resemble a remote control for a television set. Pickup 100 can include a wireless interface, such as an infrared or Bluetooth transmitter, and/or pickup 100 can include a wired data input/output interface, such as a universal serial bus (USB) port. External computer system 304 can be equipped with the proper interface and can employ software to interact with pickup 100 and allow a user to modify the configuration of pickup 100. A user can modify the sound of one or more instrument strings 206. For instance, the software may enable the user to individually control the volume of the strings, adjust the tone of an individual string, add an effect (e.g., vibrato) to the sound of a string, or the like. As another example, the sound of each instrument string 206 can be positioned in a stereo field. In one embodiment, an "optical vibrato" can be achieved by modulating the brightness of one or more of the light sources 102 via the supporting electronics in pickup 100 at a relatively low frequency (e.g., 0-50 Hz). Other modulations or tone variations can also be achieved by modulating the brightness of one or more of the light sources 102 at a high frequency (e.g., 50-20 k Hz) and with a particular modulation waveshape. The microprocessor unit 314 internal to pickup 100 can also store and retrieve settings made by the user. Therefore various different settings programmed by the user, as described above, can be stored as "presets", and called up using one or more of the possible control methods, allowing the user to change the sound of the instrument between songs or performances, or during a song or performance.

Various mechanisms can be employed to power pickup 100. In one scenario, pickup 100 can be powered by battery 310, which can be included with pickup 100 or included separately on the instrument 302. Battery 310 can be rechargeable or replaceable. Alternatively, or additionally, pickup 100 can be powered by an external power source. In addition to powering pickup 100 itself, an external power source can serve to recharge battery 310. In one embodiment, the external power source can be powering device 308. Powering device 308 can serve as an intermediary, transmitting a sound signal received from pickup 100 via cable 312 to amplifier 306 while also conducting power to pickup 100 via cable 312. Powering device 308 itself can be battery-powered and/or can be connected to an external power source. Powering device 308 can be a multi-purpose device. For example, powering device 308 can provide functionality similar to a guitar effects pedal and can have the same form factor as a typical guitar effects pedal. Cable 312 can enable the transmission of a sound signal from pickup 100 while also transmitting power to pickup 100 from powering device 308. In one scenario, cable 312 can be a tip, ring, and sleeve (TRS) cable, thereby including three conductors. For example, the tip may conduct the sound signal to powering device 308, the ring may conduct the power to pickup 100, and the sleeve may serve as the ground connection. Alternatively, cable 312 can be a two conductor cable, such as standard electronic guitar cable, and pickup 100 and/or the powering device 308 can include a mechanism to enable the receipt and/or transmission of a power signal.

FIG. 5 illustrates an embodiment in which the optical components of the pickup 110 are in a self-contained unit. A housing 510 is formed of a material to block light other than through a transparent top window 512. This window is not necessary, but may be desirable to protect the critical optical components below. In use, the window is positioned below the associated instrument string. Fasteners 514 and 516 secure the printed circuit board, to the housing. While the side view of FIG. 5 shows only one light source 102 and one photoreceiver 104, there typically is an array of light sources and photoreceivers. Similarly, only two electrical leads 518 and 520 are shown. Conventionally, two electrical leads 518 are provided to power each light source and two electrical leads 520 are used to channel electrical signals from each photoreceiver.

Figure 6:
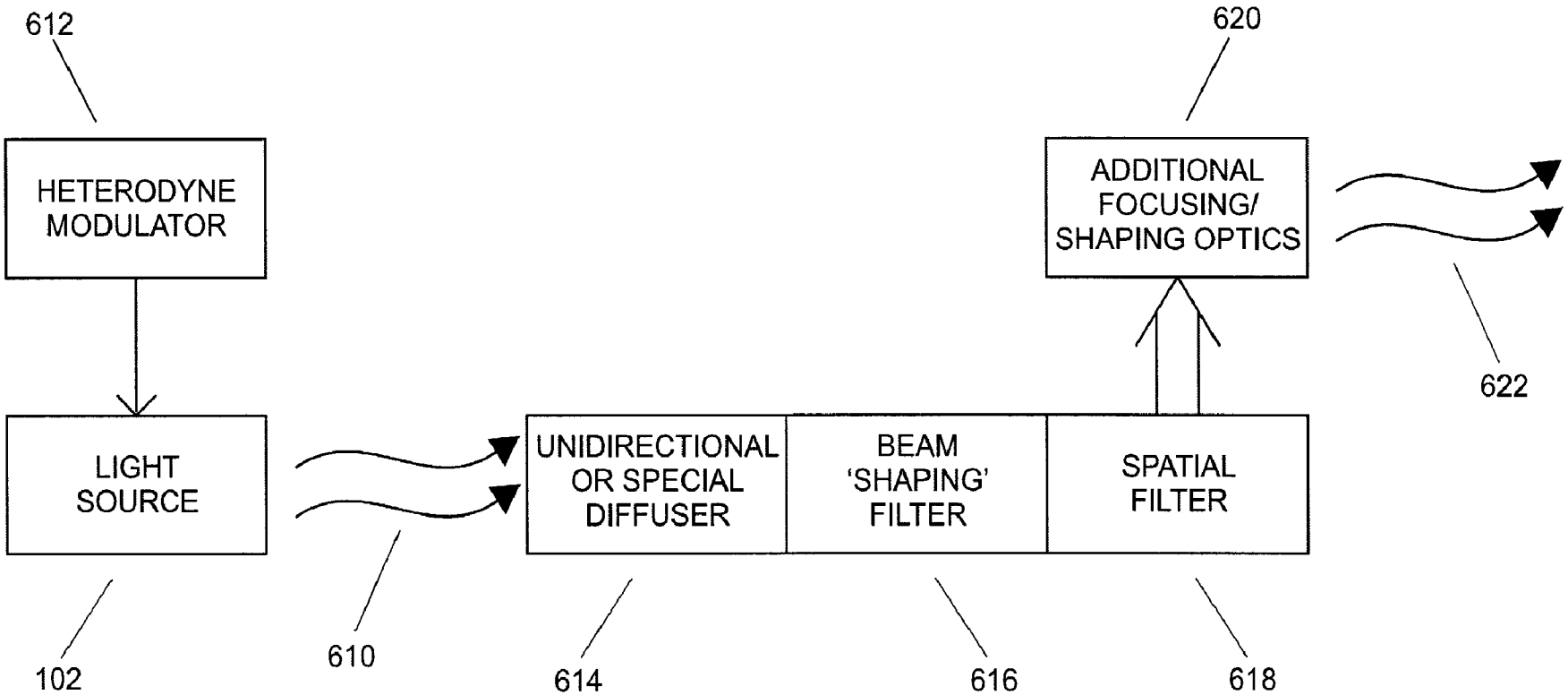
FIG. 6 is a block diagram of pre-reflection components relevant to filtering spacious light in accordance with the invention.

FIG. 6 is a block diagram of the "pre-reflection" components described below. That is, they are possible components for determining the characteristics of light that is directed toward the instrument string for reflection. The light source 102 described above generates light 610. With respect to filtering spurious light, there are two characteristics of the light energy that may be utilized. Firstly, there may be a matching of the frequency of the light with the bandwidth of the photoreceiver that is used to detect reflections from the instrument string. This matching was previously described. Secondly, a heterodyne modular 612 may be used to provide modulation at a specific frequency that is higher than the highest audible frequency produced by the vibration of the instrument string. As a consequence, the modulation frequency can be considered as the carrier upon which the string vibration signal is superimposed. Signal processing that is downstream of the associated photoreceiver can then be configured to demodulate the received light signal so as to remove the carrier, thereby filtering spurious signals from exterior light sources.

The light 610 may past through any one or more of a diffuser 614, a beam "shaping" filter 616, and a spatial filter 618. These three components are shown as connected boxes, because a single component may be employed to provide all four functions. However, it is not necessary to have all of the functions in order to take advantage of the benefits of the present invention. The diffuser may be unidirectional. That is, an optical filter may be provided to diffuse the light in one direction, but not the other. A lenticular array functions well. The beam "shaping" filter may be one or more lenses that are used at the light source side in order to concentrate or shape the light. As previously noted, distinct optical filters may be placed over one or more individual light sources in order to achieved desired results. The spatial filter may be structure-based, such as one or more openings that channel the emitted light 610 in a particular fashion, such as by narrowing the light in one direction. For example, the beam shaping and spatial filtering functions may be performed by providing an optical filter that is designed to include one or more grooves that run along its entire length. Other optical filters may also be used instead of, or in addition to those described above, and any of these filters may be changed in order to create a unique sound or special sound effect if desired.

Figure 7:
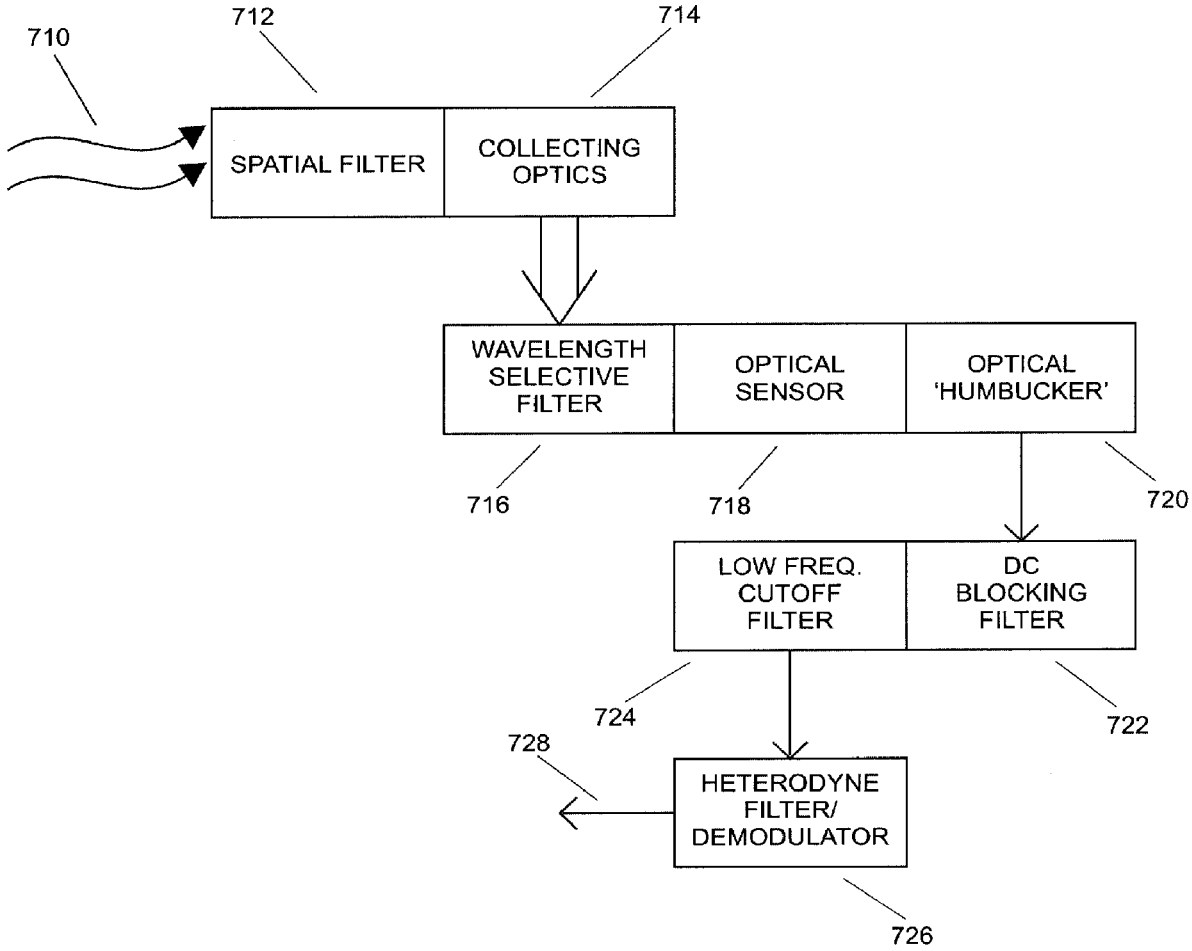
FIG. 7 is a block diagram of post-reflection components relevant to filtering spacious light in accordance with the invention.

Focusing/shaping optics 620 may be included to be specific to filtering at the receiver end. That is, this structure may be specific to special filters at the post-reflection side (i.e., the side dedicated to reception of the light following reflection from the instrument string). Light 622 from the optics is directed toward the anticipated petition of the instrument string. FIG. 7 illustrates the possible arrangement of components at the post-reflection side. Components which may be isolated or combined are shown in the same level of the four-level arrangement of FIG. 7. For example, the spatial filter 712 and the collecting optics 714 may be a single component that provides both functions. Alternatively, the two functions are provided by different components. Spatial filtering may be achieved by barriers placed between the photosensors described above. The barriers are positioned to reduce the likelihood that a photosensor will receive reflected light from an unassociated instrument string. The collecting optics may be the cylindrical lens 106 shown in FIG. 5.

At the next level of FIG. 7, a wavelength selective filter 716 precedes the photosensor 718. While the first level manipulates the "raw optical information", the second level provides manipulation of the optical information. The wavelength selected filter may be cooperative with the focusing/shaping optics 620 of FIG. 6 to pass only a desired range of wavelengths, or may be incorporated in the properties of photosensor itself as previously described The photosensor converts the optical information to electrical signals. An optical humbucker 720 has been described above as having an embodiment in which signals from a pair of adjacent photosensors are inverted. Then, when the normal and inverted signals are summed, the common-mode component of the modulated received signal that comes from room lighting entering the pair of photosensors will cancel out, suppressing the spurious light signals, and reducing the interference from external light sources.

At a next level a DC blocking filter 722 and a low frequency cutoff filter 724 provide processing to remove unwanted low-frequency information including non-modulated external light, and occasional reflected light from the player's fingers or pick. Then, a heterodyne filter-demodulator 726 functions to remove the modulation introduced by the modulator 612 of FIG. 6. The output 728 is introduced to conventional circuitry, such as an amplifier.

While the invention is well suited for use with an electric guitar, the invention is not limited to such applications. The optoelectronic pickup may be used with any string instrument, such as metal string acoustic guitars, non-metal string guitars, violins, cello, acoustic basses, and even some percussion instruments, such as xylophones and an optical drum microphone. It is also possible to utilize the pickup with additional sensor elements which are sensitive to instrument body vibrations in addition to the string vibrations, so as to combine them to produce a richer, more adjustable tone. As another possibility, the motions of non-music-related vibrating elements may be sensed and measured.

What is claimed is:

1. An optoelectronic pickup of a string musical instrument comprising:

at least one light source positioned to direct light to impinge an instrument string of said musical instrument;

at least one photoreceiver located to detect reflected light from said instrument string for generating an electrical signal that is responsive to said detection of said reflected light; and a plurality of dissimilar filters in which each said filter is specific to controlling affects of spurious light upon said electrical signal, said plurality of dissimilar filters comprising at least two of a structure-based filter, a signal processing-based filter, a wavelength-selective filter, and an optics-based filter, said spurious light being light energy that is directed toward said photoreceiver and that is unrelated to a condition of said instrument string.

2. The optoelectronic pickup of claim 1 further comprising a signal processor coupled to said photoreceiver to accept said electrical signal, said signal processor configured to provide electronic filtering as at least one said filters for controlling said affects of spurious light, said plurality of filters also including an optical filter.

3. The optical pickup of claim 2 wherein said light source is coupled to a modulator configured to operate in a modulation mode so as to introduce modulation into light emitted therefrom, said signal processor coupled to a demodulator configured to remove affects of said modulation from said electrical signal.

4. The optoelectronic pickup of claim 2 further comprising a plurality of said photoreceivers in which each said photoreceiver is uniquely associated with a different instrument string of said musical instrument, wherein said photoreceivers are connected such that said electrical signal generated by a particular said photoreceiver is inverted relative to said electrical signal of each adjacent said photoreceiver, said signal processor coupled to a summing arrangement configured for cancelling said affects of said spurious light that is simultaneously received at a plurality of said photoreceivers.

5. The optoelectronic pickup of claim 1 wherein said plurality of filters includes a filter arrangement configured for tuning and emission bandwidth of said light source to a detection bandwidth of said at least one photoreceiver, such that said emission bandwidth is preferentially detected in generating said electric signal.

6. The optoelectronic pickup of claim 5 wherein said light source in each said photoreceiver comprises GaAIAs.

7. The optoelectronic pickup of claim 1 wherein said plurality of filters includes a focusing lens aligned with each said photoreceiver.

8. An optoelectronic pickup for a musical instrument having a plurality of instrument strings comprising:

an array of light sources arranged to direct light to impinge said instrument strings;

an array of photoreceivers arranged to receive said light following reflection from said instrument strings, each said photoreceiver having an output signal that is indicative of a parameter of light sensed at said photoreceiver; and a signal processor coupled to receive said output signals and configured to discriminate said light directed by said light sources and reflected to said instrument strings from other light sensed and said photoreceivers, wherein discrimination is based on at least one of frequency demodulation of modulated light emitted by the array of light sources and relative inversion of said output signals of adjacent said photoreceivers in said array.

9. The optoelectronic pickup of claim 8 wherein said light sources are activated at a modulation frequency, said signal processor including filters in which said discrimination is provided by demodulation at said modulation frequency.

10. The optoelectronic pickup of claim 8 wherein said photoreceivers are coupled such that said output signals of adjacent said photoreceivers in said array are inverted, said signal processor including filters in which said discrimination is provided by summing said inverted output signals of said adjacent photoreceivers to cancel common signal components.

11. The optoelectronic pickup of claim 8 wherein said light sources and said photoreceivers have wavelength bandwidths that are generally tuned so as to be preferential with respect to a common band of wavelengths.

12. An optoelectronic pickup of a string musical instrument comprising:

at least one light source position to direct light to impinge an instrument string of said musical instrument;

at least one photoreceiver located to detect reflected light from said instrument string for generating an electrical signal that is responsive to said detection of said reflected light;

a plurality of dissimilar filters in which each said filter is specific to controlling affects of spurious light upon said electrical signal, said spurious light being light energy that is directed toward said photoreceiver and that is unrelated to a condition of said instrument string;

said filters including structure which dictates a permissible light path to said photoreceiver.

13. The optoelectronic pickup of claim 12 wherein said structure includes a light barrier that is positioned and dimensioned to substantially limit said light path to said photoreceiver to one in which said reflected light from said instrument string reaches said photoreceiver.

14. The optoelectronic pickup of claim 13 wherein said light barrier is a member having an opening to a lens which focuses said reflected light upon said photoreceiver.

15. The optoelectronic pickup of claim 14 wherein said lens is a cylindrical lens.

16. The optoelectronic pickup of claim 12 wherein said structure is tubular and includes internal ribs which inhibit internal reflections.

17. The optoelectronic pickup of claim 12 wherein said photoreceiver is offset to being directly aligned with said instrument string to accommodate cone-shape projection of said light from said light source.

18. The optoelectronic pickup of claim 1 wherein said plurality of dissimilar filters comprises at least one filter arrangement associated with the at least one light source and at least one filter arrangement associated with the at least one photoreceiver.

19. The optoelectronic pickup of claim 1 wherein said plurality of dissimilar filters comprises at least two dissimilar structure-based filters, at least two dissimilar signal processing-based filters, at least two dissimilar wavelength-selective filters, and at least two dissimilar optics-based filters configured to control affects of spurious light using different mechanisms.

20. The optoelectronic pickup of claim 1 comprising a powering device comprising an internal power source supported by the musical instrument or a power source external to the musical instrument.

21. The optoelectronic pickup of claim 1 comprising a power delivery box separate from the musical instrument and including a powering device configured to supply power to the optoelectronic pickup via a detachable cable, the power delivery box configured to receive the detachable cable configured either as a power cable, a combined power and signal carrying cable, or a mono cable.

22. The optoelectronic pickup of claim 13 wherein said light barrier comprises a member having an opening to a lens which focuses said reflected light upon said photoreceiver, the lens focused at a surface of the member and the opening sized to pass essentially only the reflected light from said instrument string and imaged by the lens.

23. The optoelectronic pickup of claim 12 wherein:

each of said light sources is configured to direct light to impinge on a plurality of instrument strings of said musical instrument and one of said photoreceivers is located to detect reflected light from one instrument string; and said photoreceivers arranged offset to being directly aligned with said instrument strings to accommodate projection of said light from said light sources.

24. The optoelectronic pickup of claim 12 wherein:

each of said light sources is configured to direct light to impinge on one of a plurality of instrument strings of said musical instrument and one of said photoreceivers is located to detect reflected light from one instrument string; and said light sources and said photoreceivers arranged in alignment with said instrument strings.

* * * * *

UNITED STATES PATENT AND TRADEMARK OFFICE

CERTIFICATE OF CORRECTION

PATENT NO. : 7,977,566 B2
APPLICATION NO. : 12/561409
DATED : July 12, 2011
INVENTOR(S) : Waleed Sami Haddad It is certified that error appears in the above-identified patent and that said Letters Patent is hereby corrected as shown below:

In the Claims

Column 11, line 55, Claim 5: “tuning and emission” should read --tuning an emission--.

Signed and Sealed this
Thirteenth Day of September, 2011

David J. Kappos

David J. Kappos
*Director of the United States Patent and Trademark Office*